US005875920A

United States Patent [19]

Parent

[11] Patent Number: 5,875,920

[45] **Date of Patent: *Mar. 2, 1999**

[54] CAULKING GUN

[76] Inventor: Rodger G. Parent, 1252 Oakview Ave., Clearwater, Fla. 34616

[ * ] Notice: This patent issued on a continued prosecution application filed under 37 CFR 1.53(d), and is subject to the twenty year patent term provisions of 35 U.S.C. 154(a)(2).

[21] Appl. No.: 681,899

[22] Filed: Jul. 29, 1996

[51] Int. Cl.[6] ..... B67D 5/00

[52] U.S. Cl. ..... 222/1; 222/80; 222/327; 222/391

[58] Field of Search ..... 222/326, 327, 222/391, 1, 80

[56] References Cited

U.S. PATENT DOCUMENTS

| | | | |
|---|---|---|---|
| 2,889,085 | 6/1959 | Collins | 222/391 |
| 3,606,085 | 9/1971 | Spilman | 222/80 X |
| 4,635,821 | 1/1987 | Shaffner | 222/80 |

*Primary Examiner*—Kevin P. Shaver
*Attorney, Agent, or Firm*—Pendorf & Cutliff

[57] ABSTRACT

A caulking gun which is similar to a conventional caulking gun in all respects except that it is reduced in length, and accepts a caulking compound cartridge with a tube length preferably approximately one-half the length of a conventional cartridge tube. The caulking gun can fit into tight spaces such as cupboards, closets, behind doors, etc.

3 Claims, 2 Drawing Sheets

CAULKING GUN

FIELD OF THE INVENTION

The present invention concerns a caulking gun which is similar to a conventional caulking gun in all respects except that it is reduced in length, and accepts a caulking compound cartridge with a tube length preferably approximately one-half the length of a conventional cartridge tube. As a result, the caulking gun can fit into tight spaces such as cupboards, closets, behind doors, etc.

BACKGROUND OF THE INVENTION

In the application of caulking compounds and other viscous materials, widespread use is made of caulking guns. Caulking guns as such are well known in the art and widely used. The most common caulking guns fall into one of two general classifications.

The first type is a B-D gun or a bulk dispensing gun which is a complete unit unto itself, containing a closed cylindrical chamber or shell with nozzle and actuating means.

The second type of commonly used caulking gun is one that has an open framed supporting structure with an actuating mechanism, and is designed to accept a separate disposable cartridge that has its own nozzle. The open framed cartridge gun (C-gun) essentially comprises two separate elements, i.e., the caulking gun being the first element, and the cartridge and its nozzle being a second separate and disposable element. The present invention is concerned primarily with the C-gun type caulking gun, and in the following discussion the term "caulking gun" should be understood as referring to the second or C-gun type.

Typically, caulking guns are constructed to provide a cradle to receive a cartridge containing caulking compound. The cartridge has a dispensing nozzle at one end and a piston within it which can be urged against the compound via displacement of a push rod and thrust disk associated with the caulking gun. These cartridges are approximately 2–3 inches in diameter and about 8–12 inches in length.

The caulking gun has an open framed or cradle into which the caulk cartridge can be introduced, and a reciprocating stem or push rod having a thrust disk at the front end. The thrust disk can be urged against the caulk cartridge piston which in turn acts to force caulking compound out of the cartridge nozzle. Typically, the push rod is actuatable by a manual lever or trigger which actuates a driving pawl or dog which reciprocates in step as the trigger is manipulated.

Many attempts have been made to improve caulking guns. See, for example, U.S. Pat. No. 1,986,166 which discloses a caulking gun with an outboard rearwardly mounted plunger release and a forward trigger pivoted below the plunger shaft drive grip. U.S. Pat. No 2,530,359 discloses a caulking gun with forward trigger pivoted below the plunger shaft drive grip and forward release.

U.S. Pat. No 2,561,825 discloses a caulking gun with forward trigger pivoted below the plunger shaft drive grip and plunger shaft release having a substantially horizontal control lever above the plunger shaft. U.S. Pat. No. 4,213,546 shows a caulking gun with an improved cap for the cartridge nozzle, and U.S. Pat. No. 4,135,644 shows such a caulking gun having a cartridge nozzle cutting hole in its handle and also having a cartridge puncturing tool retractably mounted in its handle.

U.S. Pat. No. 3,726,440 teaches a caulking gun with a telescopic tubular casing for holding a caulk cartridge. The caulking gun can be provided with an extension member and be telescoped out to a greater length so as to reach distant areas.

Further reference may be made to U.S. Pat. No. 5,137,184; U.S. Pat. No. 4,258,884; U.S. Pat. No. 3,726,440; U.S. Pat. No. 5,017,113; U.S. Pat. No. 3,651,994; U.S. Pat. No. 5,188,259; and U.S. Pat. No. 3,774,816.

A readily apparent common feature in all these devices is the requirement for a push rod which is hand jacked to push the movable piston within the essentially rigid and round caulk cartridge. Obviously, in order for the push rod to be able to urge the thrust disk along the entire length of the cartridge, the push rod must be at least as long as the cartridge, plus the length of the path through the pistol grip which the push rod must travel. In addition, a small segment of the push rod must remain exposed after the cartridge has been depleted, so that the exposed segment of the push rod can be grasped by hand, rotated to disengage from the ratcheting pawls, and retracted to the starting position.

It can thus be readily calculated that, for a cartridge length of 8 inches, the push rod may be 12 inches in length. Assuming a further two inches of nozzle length, it becomes apparent that the total length of the caulking gun, at the time the caulking tube is full, is approximately 23 inches. Such caulking guns are awkward and cannot fit into tight spaces such as cupboards, closets, behind doors, in attics, in boats, etc.

While a wide variety of improvements have been proposed for caulking guns, no improvements have been proposed which would solve the problem of access to tight spaces.

It is an object of the present invention to provide a caulking gun which is makes use of conventional cartridges, yet permits access to tight spaces.

SUMMARY OF THE INVENTION

After years of working with standard length caulking guns and experiencing the inconvenience of inaccessibility to tight spaces, the present inventor conceived of the idea of simply reducing the length of a standard caulking gun such that the cradle is designed to receive cartridges of standard diameter, but at most 5 inches, preferably at most 4 inches, in length. The caulking gun of reduced length can accept either cartridges especially manufactured with a tube length of at most 5 inches in length, preferably at most 4 inches in length, or can accept cartridges made by cutting conventional cartridges approximately in half after half the caulking material in the conventional cartridges has been expended. That is, after a conventional length cartridge is half used in a conventional caulking gun, the expended four inches of the cartridge tube can be cut off, leaving a cartridge tube of four inches in length. The caulking gun of the present invention is designed to receive such a reduced length, but standard diameter, caulk cartridge.

The present invention thus concerns a caulking gun which is similar to a conventional caulking gun in all respects except that it is reduced in length, and accepts a tube of caulking compound of the same diameter as a conventional tube, but preferably approximately one-half the length of a conventional tube. As a result, not only can the cradle of the caulking gun be reduced by about four inches in length, but also the pushrod can be reduced by an equal amount. The resulting caulking gun is thus reduced in length by 8 or more inches, and can fit into tight spaces such as cupboards, closets, behind doors, etc., which would be inaccessible to a conventional length caulking gun.

The foregoing has outlined rather broadly the more pertinent and important features of the present invention in order that the detailed description of the invention that follows may be better understood and so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other caulking guns for carrying out the same purposes of the present invention. It should also be realized by those skilled in the art that such equivalent structures do not depart from the spirit and scope of the invention as set forth in the appended claims.

BRIEF DESCRIPTION OF THE DRAWINGS

In order to facilitate an understanding of the invention, the invention will be discussed with reference to the drawings, wherein there is shown.

DETAILED DESCRIPTION OF THE INVENTION

The present invention is directed to a caulking gun which may be constructed according to a great variety of different conventional designs, and which may share features with a variety of conventional caulking guns, except that the caulking gun of the present invention is reduced in length in the cradle and in the push rod.

The term "caulk" is used throughout the application, but it will be readily understood that the invention is not limited to any one particular material, and that the material being dispensed may be selected from a wide variety of materials such as sealants and adhesives, viscous grinding compounds and lubricating materials, paints, colors and colorants, and even food materials.

As with conventional caulking guns, the caulking gun of the invention has an open framework for receiving and cradling a caulk cartridge, a forwardly disposed end plate which acts as a stop and which has a recess for receiving the nozzle of the caulk cartridge, a rearwardly disposed end plate, and a trigger actuating mechanism operative on the cartridge piston.

Since the cradle is dimensioned to receive a conventional diameter caulk cartridge, the result is a caulk dispensing system which is perfectly compatible with existing systems since it can receive half expended conventional cartridges. The gun provides a rigid, sturdy system, applicable for use with such materials a caulking sealants and adhesives, viscous grinding compounds and lubricating materials, paints, colors and colorants, and even food materials. The gun may be operated with one hand in cramped spaces. The system protects the materials to be extruded so that dangers due to tearing or puncturing of containers, loss of volatile materials and deleterious effects of material such as oxygen and moisture are minimized.

Figure 1:
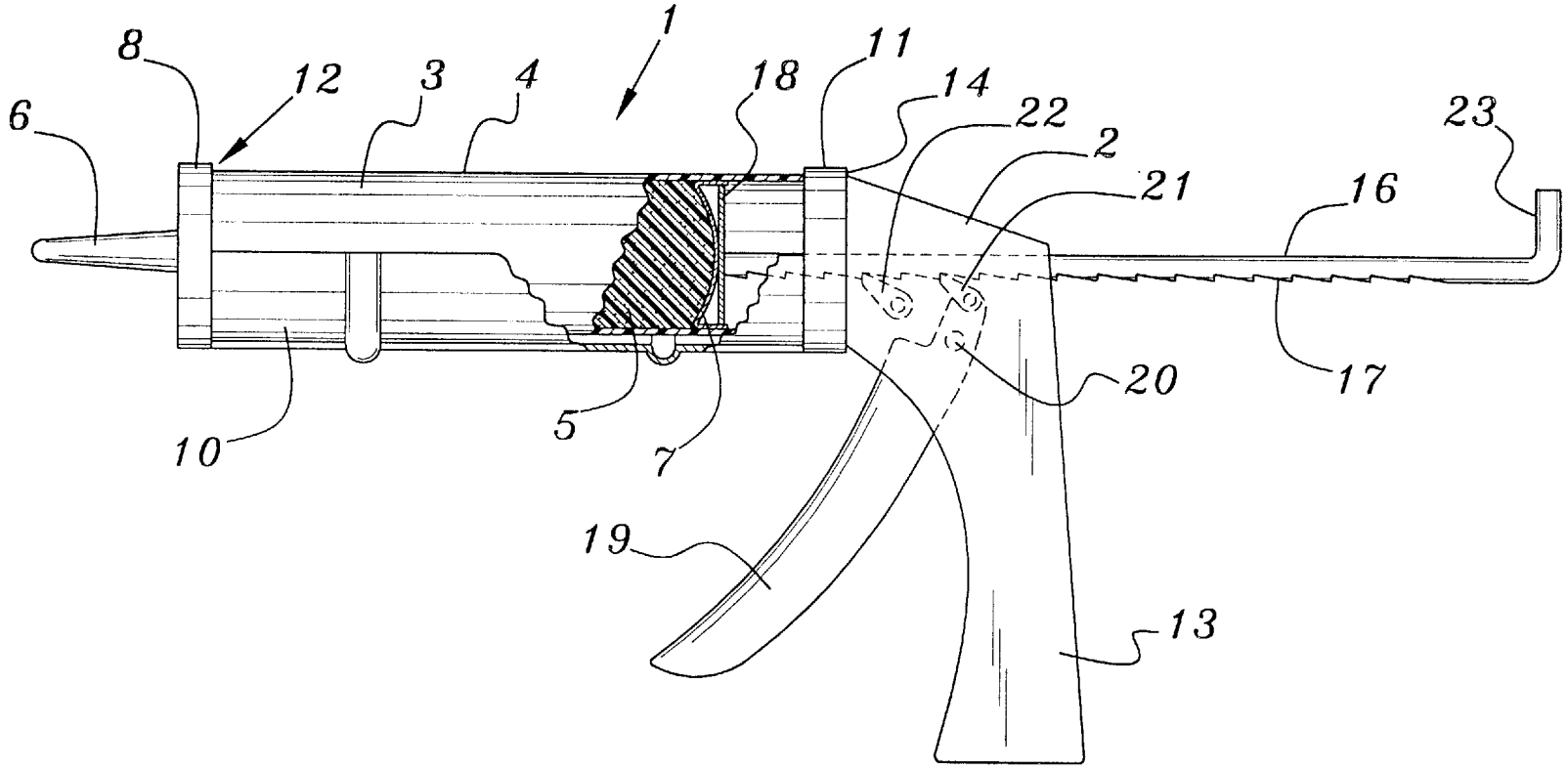
FIG. 1 is a side elevational view of a caulking gun with a portion of the cartridge broken away to show the caulking material and cup-shaped piston in the cartridge.
Figure 2:
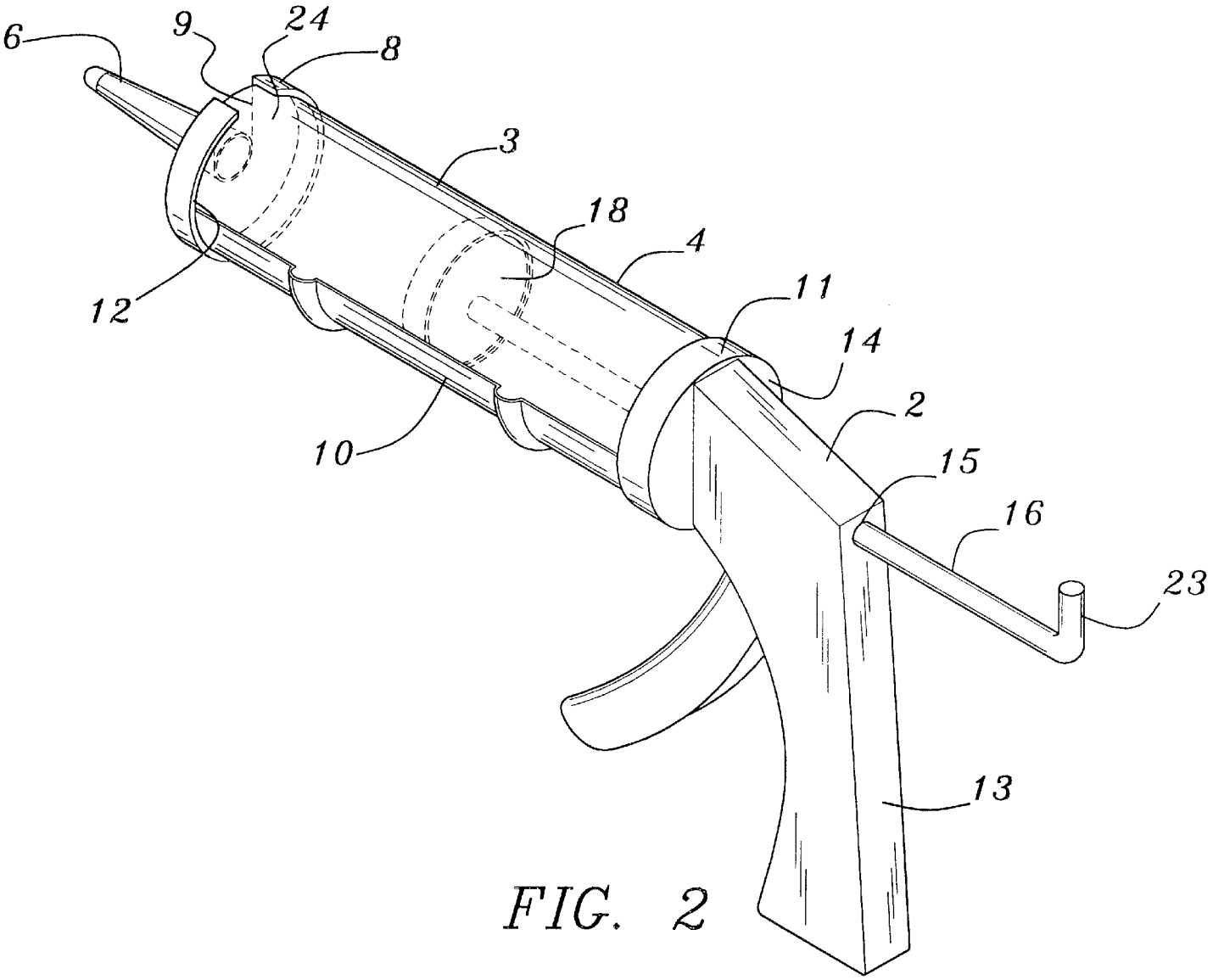
FIG. 2 is an isometric view of the caulking gun of FIG. 1, with the plunger slightly more advanced.

Referring now to the drawings, wherein like reference numerals designate like or corresponding parts throughout the several views, there is shown in FIG. 1 a caulking gun 1 comprising a stock 2 and a cartridge holder or open structured supporting framework to be described. The cartridge holder supports a half cartridge 3 having a cylindrical body 4 containing a viscous caulking mastic such as a thixotropic caulking material or compound 5. One end of the cylindrical cartridge body 4 is provided with an extrusion nozzle 6. The other end of the cylindrical cartridge body 4 encompasses a freely movable cup-shaped movable member or piston 7, which piston 7 is slidable along the tubular length of the caulk cartridge body.

The open structured supporting framework or open framework of the gun 1 comprises a forwardly disposed rim or ring member 8 and end plate 24 which includes a recess 9 for receiving, guiding and retaining the nozzle 6 of the caulk cartridge, and which is attached to the forward end of a semi-cylindrical body portion 10. The design of the cradle part of the caulking gun 1 may vary widely, and may be a substantially solid shell such as a half cylinder as shown in the figures, or may be formed of or defined by a number of skeleton frame members (shown in patents incorporated herein by reference). The inner periphery of ring 8 presents an annular lip or edge 12 into which the caulking tube is urged as the tube is urged forward. The rearward half of cradle half cylinder 10 is attached to a second ring or rim member 11 and back plate 14, the rim member 11 and back plate 14 together forming a receptacle, which is attached to a stock 2 with a handle 13 depending therefrom. The back plate 14 has a central through-hole 15 for unobstructed passage therethrough of a longitudinally extending push rod or stem 16. The lower side of the operating push rod 16 has a set of ratchet teeth 17 thereon to facilitate the controlled advancement of the push rod and the thrust disk 18 which is connected to the forward end of push rod 16.

The operating mechanism for the caulking gun 1 may be any of those conventionally employed and shown in the patents discussed in the background section. In the one embodiment as shown in the present illustrative figures, the operating mechanism comprises a trigger-like lever 19 pivoted as at 20 on the handle 13 and has a spring-pressed pawl 21 at its upper end to engage the teeth 17 for moving the push rod 16 and the attached thrust disk 18 as the lever 19 is urged towards handle 13, with a second spring biased pawl 22 also pivoted to handle 13 to retain the forward movement of the rod 16 and thrust disk 8. The trigger like lever 19 may have a spring (not shown) suitably attached to it to bias it away from handle 13, and to hold it in its rest position shown in FIG. 1 for operation.

After the thrust disk 8 and its push rod 16 have been fully displaced forwardly in its stepped operating condition by the pawl 21, the push rod 16 may be retracted after the caulking cartridge 3 has been emptied by providing a retractor handle 23 on the free end of the push rod 16. Such handle 23 facilitates the rotation of the push rod 16 to disengage the pawls 21 and 22 from ratchet teeth 17 so that the push rod 16 and thrust disk 8 may be retracted linearly out of and away from the caulking cartridge 3 so that such cartridge 3 can be removed from the caulking gun 1.

The cartridge 3 with cartridge tube 4 and nozzle 6 constitutes a complete unit in itself and presents a nozzle that is not reusable.

As an example of the dimensions of such a cartridge, the outside diameter of cartridge tube 4 is between 2 and 3 inches, the length of the cartridge tube 4 is from 4 or less to 5 inches or less, with an overall length of nozzle of between 1 to 3 inches.

The caulking gun of the present invention can be constructed in a manner similar to methods for constructing conventional caulking guns. The cradle for receiving a conventional cartridge of caulking or other mastic compound, is customary configuration and includes the semi-cylindrical body portion 10 as a chamber, a front wall 24 fixed to the forward end of the body portion 10 and provided with the conventional vertical slot 9 for receiving the nozzle of a caulking cartridge, and a rear wall 14 fixed to the rear end of the body portion 10. The front end of the tubular front section 10 is welded or otherwise fixedly secured to the rear surface of the wall 24 or ring 8. A central opening 15 is formed in the rear wall 14 for supporting and guiding the forward end of the push rod 16.

The forward end of the push rod 16, which extends through opening 15 into the cradle, is provided with a heavy metal thrust disk 18 riveted or otherwise secured to the forward end of the push rod 16.

The caulking gun shown in FIG. 1 is substantially shorter than the conventional length caulking gun since it is shortened in both the cradle and the push rod. That is, any shortening of the tube and cradle brings about a corresponding shortening of the push rod, so the effect of each cradle shortening is effectively doubled.

Rather than being constructed as discussed above, the caulking gun may include a trigger assembly provided with a customary trigger and ratchet feed and holding pawls for engaging the ratchet teeth of the push rod, and may feature a rotary connection between the trigger assembly and the cartridge chamber. Alternative caulking gun designs which can be used in the present invention are shown in U.S. Pat. Nos. 5,137,184; 4,509,662; 4,390,115; 4,081,112; 4,135,644; and 3,997,085.

In order that the present caulking gun will be strong, durable and not readily damaged due to rough handling and at the same time will be as light in weight as possible, the tubular cradle is preferably made of a light weight material such as aluminum or magnesium or an alloy of such metals. Obviously, the cross-sectional configuration of the tubular casings may be of any desired shape, including circular or square, and the push rod activating means may be rotatable relative to the tubular casings thereof without affecting the operation and assembly of the guns.

The above examples were presented in order to illustrate the invention and are not intended to limit the invention in any way. Those working in the art would readily appreciate that substantial modifications within the scope of the invention may be made to the illustrative embodiments.

Although the caulking gun was first designed for providing a shorter overall caulking gun length, and the invention has been described in great detail using a specific caulking gun design as shown in FIG. 1 by way of example, it will be readily apparent that the caulking gun is capable of application to related applications, such as extruding glue, paint, food materials, etc., and is thus capable of use in a number of other applications. Although this invention has been described in its preferred form with a certain degree of particularity with respect to the caulking gun as shown in FIG. 1, it is understood that the present disclosure of the preferred form has been made only by way of example and that numerous changes in the details of structures and the composition of the system may be resorted to without departing from the spirit and scope of the invention.

What is claimed is:

1. A method of dispensing material from a caulking gun into unreadily accessible areas, said method comprising:

obtaining a half-expended cartridge of material having a tubular body provided with a nozzle on one end thereof and having a movable piston received within its opposite end;

trimming the tubular body of said half-expended cartridge to reduce the length thereof, placing said trimmed cartridge in a caulking gun, said caulking gun comprising:

a chamber having a front wall, a rear wall, and at least one longitudinal wall member dimensioned to receive said tubular cartridge, an inner diameter between 1 and 3 inches, and an internal longitudinal length between 3 and 5 inches;

a trigger assembly having a trigger connected to said chamber;

a push rod extending from said trigger assembly and projecting into said chamber; and thrust plate means disposed in said chamber and carried by the forward end of said push rod for engaging the cartridge piston;

engaging said trigger assembly for positioning a thrust disk against the piston of the cartridge;

placing the extrusion nozzle of the cartridge adjacent the unreadily accessible area;

operating the trigger assembly to cause the push rod to move the thrust disk and cause the piston to slide along a tubular length of the half cartridge body to force material through the extrusion nozzzle and onto the unreadily accessible area.

2. A method as in claim 1, wherein the inner diameter of said chamber is between 2 and 3 inches, and wherein the internal longitudinal length of said chamber is between 3 and 4 inches.

3. A method as in claim 1, wherein said material being extrueded is selected from the group consisting of sealants and adhesives, viscous grinding compounds and lubricating materials, paints, colors and colorants, and food materials.

* * * * *